United States Patent [19]

Kürten

[11] Patent Number: 5,001,979

[45] Date of Patent: Mar. 26, 1991

[54] PRESSURE HEAD FOR A SCREEN PRINTING PRESS

[76] Inventor: Rudolf A. Kürten, Parkstrasse 14, 5060 Bergisch Gladbach 1, Fed. Rep. of Germany

[21] Appl. No.: 753,581

[22] Filed: Jul. 1, 1985

[30] Foreign Application Priority Data

| | | | |
|---|---|---|---|
| Jul. 7, 1984 | [DE] | Fed. Rep. of Germany | 8420447 |
| Aug. 9, 1984 | [DE] | Fed. Rep. of Germany | 8423641 |
| Oct. 6, 1984 | [DE] | Fed. Rep. of Germany | 8429458 |
| Mar. 19, 1985 | [DE] | Fed. Rep. of Germany | 8508097 |

[51] Int. Cl.[5] ..... B41F 15/44

[52] U.S. Cl. ..... 101/123

[58] Field of Search ..... 101/120, 123, 124, 169

[56] References Cited

U.S. PATENT DOCUMENTS

| | | | |
|---|---|---|---|
| 3,040,442 | 6/1962 | Overton | 101/169 |
| 3,143,961 | 8/1964 | Jaffa | 101/123 |
| 3,186,339 | 6/1965 | Turner | 101/169 |
| 4,102,266 | 7/1978 | Porth | 101/124 |

FOREIGN PATENT DOCUMENTS

| | | | |
|---|---|---|---|
| 11314 | 5/1980 | European Pat. Off. | 101/120 |
| 3100383 | 1/1982 | Fed. Rep. of Germany | 101/169 |
| 32443 | 10/1962 | Finland | 101/169 |
| 1523874 | 9/1978 | United Kingdom | 101/120 |

*Primary Examiner*—Clifford D. Crowder

*Attorney, Agent, or Firm*—Browdy and Neimark

[57] ABSTRACT

In a pressure head for a screen printing press, the pressure doctor consists of a doctor bracket and an elongate support rail made of a hard resilient material inserted removably therein, and a profile bar made of a soft resilient material. This profile bar is fastened to the edge of the support rail underneath in service. A bracing profile made of a hard resilient material attached to the doctor bracket is provided to brace the support rail. Where the pressure head carries, for the purpose of better ink distribution, a preliminary doctor which is lowered alternately with the pressure doctor, this preliminary doctor is of curved and pivotable construction.

5 Claims, 8 Drawing Sheets

Fig.12
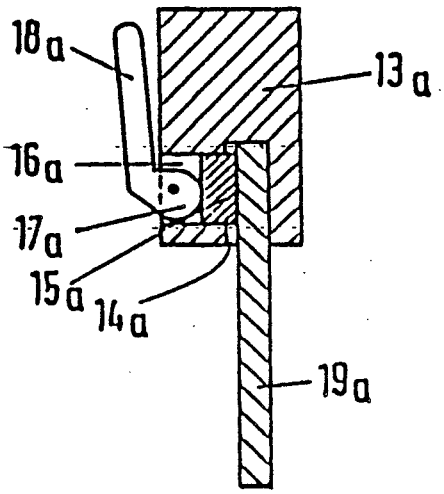
Fig.13
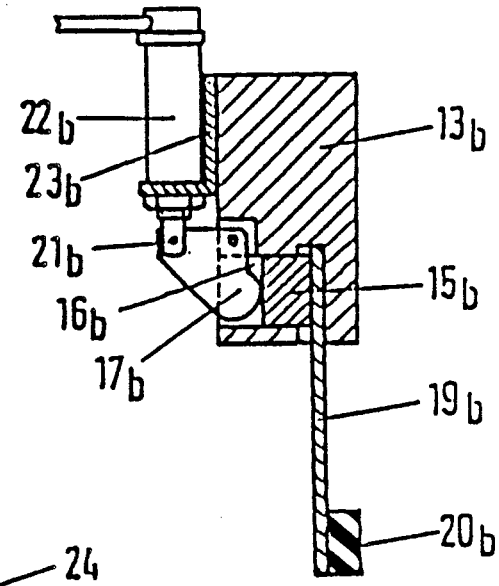
Fig. 14
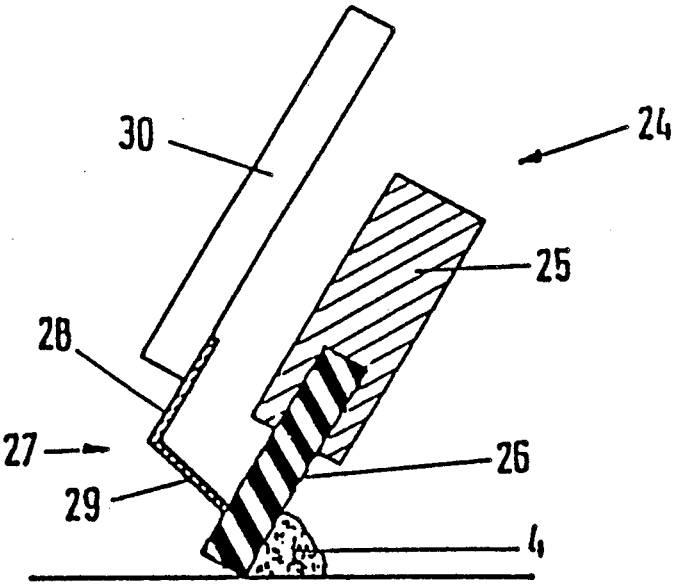
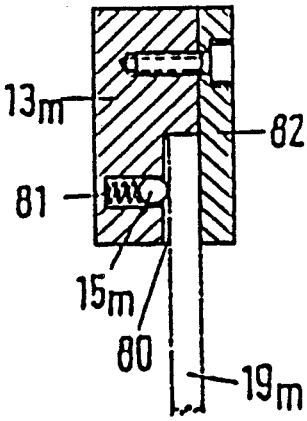
Fig. 27

PRESSURE HEAD FOR A SCREEN PRINTING PRESS

The invention relates to a pressure head for a screen printing press, which is guided with reciprocating sliding mobility in the longitudinal direction of the screen and comprises a pressure doctor oriented transversely to the longitudinal direction of the screen and lowerable onto the latter.

The pressure doctors are hitherto produced entirely from soft resilient material and exhibit an elongate rectangular cross-section. At the upper end of this cross-section the pressure doctors are clamped along their total length in a bracket, which guides them, during operation, across the screen at a given angle of incidence, so that the ink charged upon the latter is pressed through by the pressure doctor.

In order to obtain clean impressions, it is necessary for the ink to be uniformly distributed, and the pressure doctor should rest upon the screen with as uniform a pressure as possible along its total length. The pressure doctor should have a sharp edge at its lower end resting upon the screen, but should otherwise be soft resilient, so that the screen does not become damaged or prematurely worn.

On the other hand, a pressure doctor consisting of soft resilient material sags more or less under the contact pressure of the bracket device, as a result of which the angle at which the doctor rests upon the screen is modified.

The previous pressure doctors are also unstable.

If the pressure doctors are produced from a hard resilient material in order to keep their sag as slight as possible, then the screens, which consist of textiles, rapidly become damaged and/or worn. One is then compelled to use metal screens, but the latter have other disadvantages, especially that of an extremely high price.

The underlying object of the invention is to produce a pressure doctor for screen process printing which is free from the abovementioned disadvantages, but rests relatively softly directly at the point of support, but is again relatively hard above the latter, so that it does not sag too much under the contact pressure of its bracket device.

The object is achieved according to the invention when the pressure doctor comprises a doctor bracket with an elongate support rail made of a hard resilient material inserted removably into the latter, and a profile bar made of a soft resilient material located on the edge of this support rail underneath in service and connected areally to the support rail.

The areal connection may be effected in various manners, by gluing or welding for example, depending upon the materials used in individual cases.

The support rail is preferably a plate thin compared to its width, or consists of two plates arranged at a mutual interval.

The shape of the support rail may vary in relatively wide limits. The support may for example exhibit a U-shaped cross-section, while the profile bar is inserted between the ends of its two members.

Such a relatively thin support rail is virtually free from sag transversely to its longitudinal direction, because it consists of a hard resilient material, of fibreglass-reinforced polyester or also of steel, for example.

The support rail may also consist of plastics, while in a particular process of manufacture the edge of the support rail located at the bottom in service is adjusted relatively soft and the remaining parts of the support rail hard, and these two sections, which are generated in one and the same production process, are mutually integrally connected.

It is also possible for various materials to be used for the profile bar, provided that they are soft resilient on the one hand and resistant to the screen process printing inks used on the other hand. Particularly, natural or synthetic rubber may be used for the profile bars.

The connection between the support rail and the profile bar is effected by gluing or welding, or also, as stated above, by integral mutual connection of the two during production.

If the support rail consists of fibreglass-reinforced polyester and the profile bar of synthetic rubber, then it is convenient to press the profile bar on before the final curing of the polyester. An intimate connection between support rail and profile bar then occurs during curing. The method of connection is not a subject of the invention.

According to the invention the profile bar has a rectangular or L-shaped or U-shaped cross-section. However, the profile bar may also have a T-shaped or E-shaped cross-section if it is inserted between two plates or members of a support rail.

Lastly it is proposed to arrange two profile bars on both sides of the support rail and to connect them to the support rail. Then, after the one profile bar has become worn, the pressure doctor may be reversed and the profile bar on the other side used.

Although the pressure doctors proposed above are highly resistant to sagging due to the hard resilient construction of the support rail, they can be bent somewhat along their length. This is desirable if a bracket device for the pressure doctor is used which is provided with a plurality of adjusting screws distributed along the length, so that any desired distribution of the contact pressures along the length can be realised.

However, in the case of screen process printing presses in which no such possibility of adjustment is provided, it will be convenient to use pressure doctors in which the support rail comprises two plates arranged at a mutual interval.

It is however, also possible to use a support rail of U-shaped cross-section, with which a certain stiffening against sagging is likewise achieved.

It is furthermore proposed to achieve a further stiffening by one or more beads extending along the length of the support rail or of its two plates. These beads may exhibit various cross-sections, triangular, trapezoidal, square, rectangular or also circular, for example.

The fastening of the inserted profile bar in the doctor bracket is effected either by screws or by a clamping lever or also by a pneumatic or hydraulic clamping device.

However, the fastening of the profile bar may also be effected in a simple manner by a plurality of balls distributed along the length of the doctor bracket and subject to spring pressure.

The following should be observed in designing a pressure head with pressure doctor:

The quantity of ink pressed through the screen fabric by the pressure doctor, and therefore the application of ink to the print carrier, is influenced, and controlled at will, by the abovementioned force exerted upon the pressure doctor, the shape of the doctor profile and the angle of incidence of the pressure doctor relative to the plane of the screen fabric. In order to obtain uniform ink applications, therefore, the abovementioned influencing factors must be kept as constant as possible in time.

Unfortunately, however, the soft resilient materials from which the doctor profiles are produced are insufficiently stable chemically, and therefore also mechanically. Indeed, the doctor profile absorbs constituents of the printing inks during service, and its density and its shape are thereby modified, if only slightly. Then, due to these modifications to the shape and also the resilience of the doctor profile, the angle of incidence initially adjusted also becomes modified, and hence also the force exerted by the latter upon the screen fabric.

The abovementioned instability of the doctor profiles currently available, and of the materials from which they are produced, firstly has the result that the application of ink varies from impression to impression, although only quite gradually and not perceptibly to the naked eye. However, as soon as a large number of impressions have been made and the last print carrier is compared with the first, a definite difference is detected, even with the naked eye, particularly in the case of ink applications which are already extremely thin, and of glazing inks.

This difference may be tolerable in certain cases, for example, when the individual impressions are being hung in different places.

However, when it is required to assemble a large-area poster from a plurality of parts produced individually by screen process printing, in which case the ink applications extend across from one section into the other, the case may arise that a heavy impression is obtained for one section, and one produced only at the end of the printing series, and therefore weaker, for the one next to it. These differences are then immediately noticeable when the large poster is assembled, and the entire printing order can be spoiled by this.

Worn doctor profiles can obviously be exchanged for new ones. However, because the abovementioned modifications occur even after the first printing operations and in an unforeseeable manner, an exchange of the doctor profile generally comes too late. In addition, the doctor profiles require to be produced extremely precisely, that is to say, should exhibit a constant cross-sectional shape and size along their total length, and also a sharply ground pressure edge. The price of such doctor profiles is therefore extremely high. Moreover, the need to exchange a doctor profile causes an interruption in printing operations, resulting in additional expense.

In order to improve the pressure doctor in this respect, it is proposed to associate with the pressure doctor an integral or composite bracing profile made of a hard resilient material, which extends along the total length of the doctor profile and braces the latter.

It is preferably provided in this case that the bracing profile is of angular cross-sectional construction and arranged so that the end face of the free end of its one member contacts the doctor profile.

It is further proposed that the bracing profile is fastened by its other member, by means of a plurality of brackets, to a bracket rail which extends parallel to the doctor bracket and at an interval from the latter.

In this case it is preferably proposed that each bracket is pivotable about an axis which is oriented parallel to and at an interval from the doctor profile, and that adjusting means are provided to adjust the inclination of each bracket relative to the doctor bracket. Conveniently, the adjusting means each comprise an adjusting screw, which brace the bracket and the doctor bracket mutually and are engaged into a screwthreaded bore in the bracket.

If it should be discovered during printing that the doctor profile is not aligned quite uniformly along its length, or the ink application varies transversely along the doctor profile for other reasons, these irregularities can be eliminated in that the bracing profile is subdivided along its length into a plurality of mutually unconnected sections, which brace the doctor profile conjointly and with which adjusting screws are associated.

The bracing profile may, as a matter of choice, engage the pressure doctor, namely its support rail, either somewhat nearer the clamping position or else nearer the profile bar. The bracing profile is preferably slidable adjustably parallel to itself, so that by this means the spring constant of the pressure doctor, and therefore its pressure characteristics, can be modified at will.

It is further proposed that the bracing profile is pivotable about an axis which is oriented parallel to and at an interval from the work edge of the profile bar, and that an adjusting screw, which is braced against the doctor bracket, is provided for the adjustment. By virtue of this construction it is still possible, with the doctor bracket firmly clamped, to vary within certain limits the angle which the profile bar forms with the screen fabric et cetera.

Another, simpler, construction of the bracing profile consists of an angle piece associated with the pressure doctor, which contacts and braces by its one member the part of the pressure doctor adjacent to the clamping position of its support rail, and is fastened by the other member to the doctor bracket. By the choice of an angle piece with a definite length of the bracing member, it is possible here again to give the pressure doctor a specific spring characteristic.

Lastly, it is proposed to provide in the doctor bracket of the pressure doctor an articulation between the part to be clamped into the screen process printing press and the other part removably carrying the pressure doctor, with which a spring means is associated to press the clamped support rail against the screen printing surface. The contact pressure can be adjusted extremely accurately by virtue of such a construction.

The printing head of the above-described type according to the invention may also, in manner known per se, carry in addition to the pressure doctor a preliminary doctor guided with reciprocating sliding mobility conjointly with the latter, which is staggered relative to the pressure doctor in the longitudinal direction of the screen and is lowerable onto the screen and raisable alternately with the pressure doctor.

Such a known preliminary doctor serves for the uniform distribution of the printing ink applied onto the screen. In the known pressure heads the preliminary doctor and also the pressure doctor exhibit a straight work edge. However, because the screen sags in the centre in the transverse direction, the known preliminary doctor has to be pressed so far downwards that the screen is finally in more or less good contact with the straight work edge. Only then can the printing ink be distributed by advancing the preliminary doctor. However, because the known preliminary doctor has to be shorter than the width of the screen, the printing ink cannot be distributed uniformly as far as the edge of the screen.

Now in order to improve such a preliminary doctor and therefore also to make the pressure head according to the invention more efficacious, it is further proposed that the preliminary doctor exhibits an arcuate work edge and is arranged in the pressure head rotatably about an axis passing through its ends. This axis is oriented transversely to the direction of movement of the pressure head and parallel to the pressure doctor.

By pivoting about the said axis, this preliminary doctor can be lowered with its arcuate work edge onto the surface of the screen sagging in the centre in the transverse direction, while the work edge contacts the surface of the screen along its total length, so that when the pressure head is advanced the printing ink is distributed uniformly across the total width of the screen. The arcuate shape of the work edge of the preliminary doctor may be adapted to the most frequently occurring curvature of the sag of the screen. Due to the advance of the preliminary doctor with its arcuately curved work edge leading, the printing ink applied in the centre of the screen will slide to both sides along the curved work edge, so that the distribution of the printing ink is effected highly uniformly as far as the lateral edges of the screen.

The preliminary doctor is preferably formed by an arcuately curved band-shaped element. The band-shaped element is preferably provided at its ends with journals which are mutually aligned and inserted into corresponding bearings in the pressure head. By this means a smaller or greater curvature of the band-shaped element can be achieved in that the two journals, or at least one of them, are displaced in the axial direction. It is thereby possible to adapt the preliminary doctor optimally to different screens. Depending upon the material of the screen and its mesh width, it will have a greater or smaller sag in the transverse direction, to which the curvature of the preliminary doctor can then be adapted.

The invention is explained more fully below with reference to exemplary embodiments and to the drawing, wherein:

FIG. 12 shows a doctor bracket according to the invention with removable pressure doctor and clamping lever;

FIG. 13 shows a section through another embodiment of a doctor bracket with a pneumatic clamping device;

FIG. 14 shows a section through parts of a pressure head according to the invention with bracing profile;

FIG. 27 shows a section through a doctor bracket with removable pressure doctor and single ball fastening means.

Figure 1:
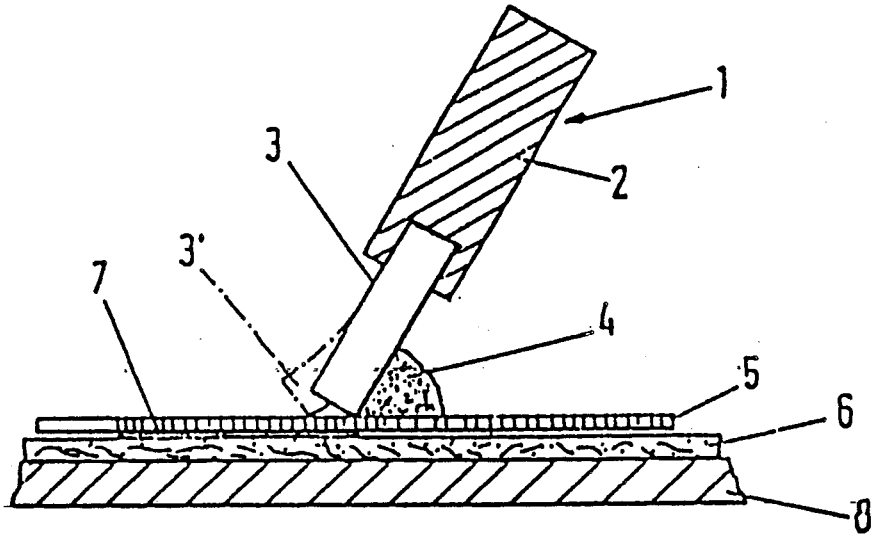
FIG. 1 shows a section through a known pressure doctor, placed on a screen fabric with print carrier on a print support, in a diagrammatically simplified illustration.
Figure 2:
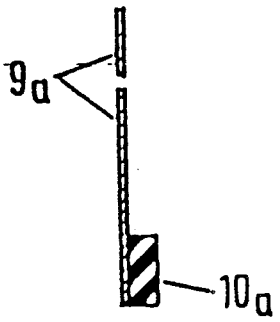
FIGS. 2 to 11 show pressure doctors of different construction according to the invention, with single and double support rail and various profile bars.
Figure 3:
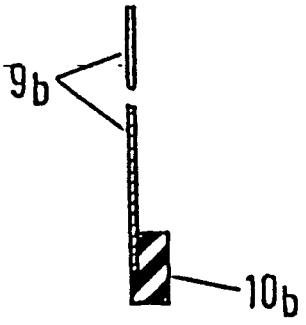
Figure 4:
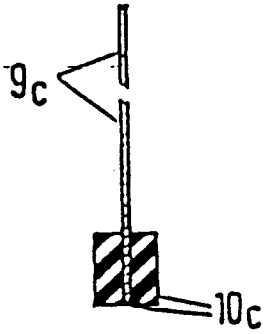
Figure 5:
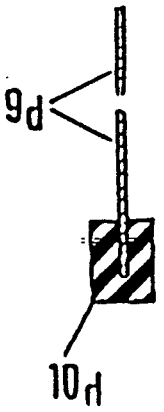
Figure 6:
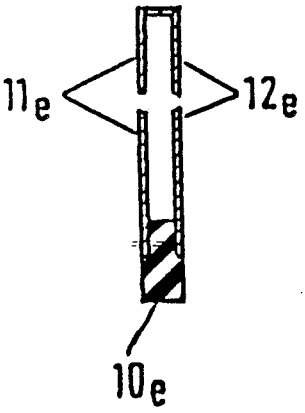
Figure 7:
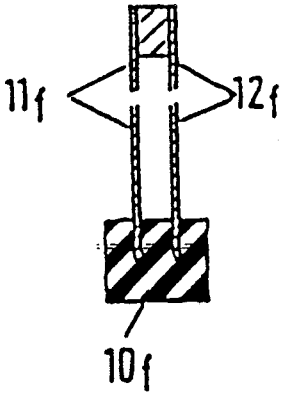
Figure 8:
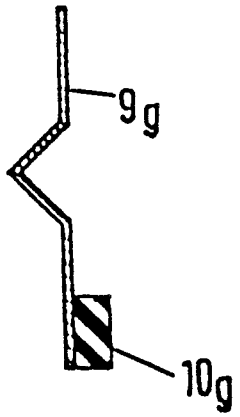
Figure 9:
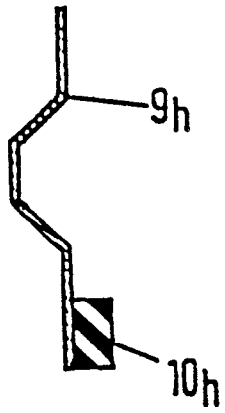
Figure 10:
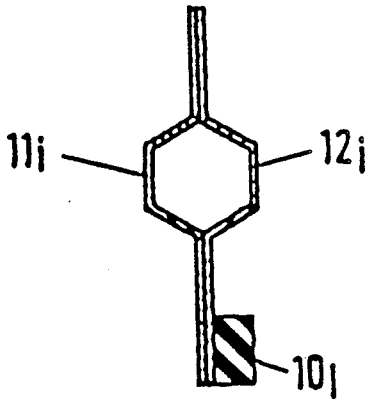
Figure 11:
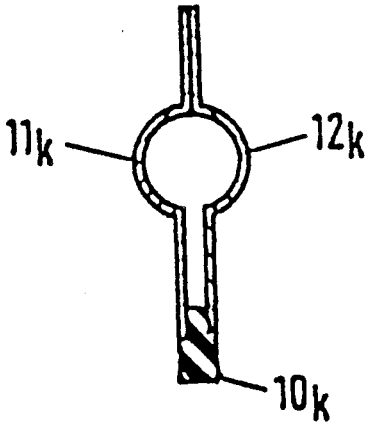

The known pressure doctor 1 illustrated in FIG. 1 consists of a doctor bracket 2 and of a doctor profile 3 inserted into a slot in a narrow side of the latter. The doctor bracket consists generally of metal or of another hard and durable material, whereas the doctor profile consists of a more or less soft resilient material, of rubber or a thermoplastic plastics material, for example.

FIG. 1 shows this pressure doctor 1 in the work position, while one edge of the end face of the free end of the doctor profile 3 is in contact with the top side of the screen fabric 5, and while the doctor profile 3 is adjusted here at an acute angle relative to the plane of the screen fabric; a quantity of ink 4 which has been applied to the screen fabric is present in the acute angle, and becomes spread across the screen fabric 5 when the pressure doctor 1 is slid to the right (in the drawing).

A given pressure, maintained constant, is exerted upon the pressure doctor 1 from above, and causes the doctor profile 3 to sag. Depending upon the intensity of its force, upon the shape and size and material characteristics of the doctor profile, the sag will be more or less pronounced, so that this also causes the angle of incidence to the screen fabric to be decreased simultaneously. Such a sagging position 3' of the doctor profile is illustrated by chain-dotted lines in FIG. 1.

During the movement of the pressure doctor 1 across the screen fabric, the printing ink 4 is pressed through the screen fabric at its permeable points, and constitutes there the printing application 7 on the print carrier 6 located beneath the screen fabric and resting upon a printing support 8. Paper, board, textiles, plastic foil et cetera serve as the print carrier.

As already explained, the contact of the doctor profile with the printing ink causes, chemically and physically, a modification of the dimension of this profile and of its mechanical characteristics, as a result of which the sag varies more or less greatly in time.

Furthermore, a varying sag along the length of the doctor profile may also result from the above-mentioned modifications.

As described above, according to the invention it is proposed to insert into the doctor bracket, not a doctor profile made of a soft resilient material, but a support rail made of a hard resilient material, which carries at its lower end a profile bar made of soft resilient material.

Various embodiments of such pressure doctors are illustrated in FIGS. 2 to 11, in which either a single support rail 9 or a double support rail 11, 12, and a profile bar 10 at its lower end, are mutually connected.

The same reference numerals, but with different indices a . . . k, are used for the various exemplary embodiments in FIGS. 2 to 11.

The embodiments according to FIGS. 6, 7, 10 and 11, with a double support rail in each case, have the advantage of even greater stability against bending of the latter. The embodiments according to FIGS. 4 to 7 of the profile bar make it possible, after the one work edge of the profile bar has become worn, to use also the opposite lower edge by simply reversing the support rail in its bracket.

The doctor brackets illustrated in FIGS. 12 to 14 and 27, which are inserted by their top side into a pressure head, each comprise an elongated block of approximately rectangular profile, which carries the support rail, or also directly a short pressure profile in the case of FIG. 14, on its underside.

The doctor bracket 13*a* illustrated in FIG. 12 carries removably in a slot 14*a* on its underside a support rail 19*a* made of a hard resilient plastic material. The anchorage is effected with interposition of a steel bar 15*a* by means of a plurality of clamping levers 18*a* distributed along the length of the pressure doctor, which are mounted pivotably in the aperture 16*a* accommodating the steel bar 15*a* and provided with eccentrics 17*a*.

A doctor racket 13*b* with accommodating slot 14*b* illustrated in FIG. 13, into which a support rail 19*b* made of sheet steel with a profile bar 20*b* made of soft rubber glued on laterally underneath is inserted. Here again a steel bar 15*b* to distribute the clamping forces is placed upon the support rail, which was introduced into the aperture 16*b*, along its total length. A plurality of cam levers 17*b* distributed along the length of the doctor bracket are also mounted pivotably in this aperture. The piston rod of a pneumatic clamping device 22*b* is articulated at 21*b* to the other ends of each of these cam levers. This clamping device is fastened to the doctor bracket 13*b* by means of an angle piece 23*b*. All the cam levers 17*b* arranged distributed along the length of the doctor bracket 13*b* may optionally be actuated by a single pneumatic clamping device 22*b*.

The pressure doctor 24 illustrated in FIG. 14 comprises a doctor bracket 25 made of metal, which can be inserted into a pressure head (not shown), and a doctor profile 26 made of a rubber of given softness inserted into a slot of the doctor bracket. In this case the doctor bracket 25 assumes the function of the support rail. This is possible because the doctor profile 26 consisting of soft rubber is braced along its total length by its side opposite the printing ink 4 by an angled bracing profile 27 made of sheet steel. The bracing profile has a lower member 29 which contacts and thereby braces the doctor profile 26 just above its lower free end. The upper member 28 of the bracing profile 27 is fastened to a bracket 30, which is likewise fastened to the pressure head.

A simplified form of fastening of the support rail in the doctor bracket is illustrated in FIG. 27. The doctor bracket 13*m*, with screwed-on cover plate 82, has on its underside a slot 80 to accommodate the top edge of a support rail 19*m*, and has a plurality of bores distributed along its length, in which compression springs 81, and balls 15*m* stressed by the latter, are present. The bores are constricted somewhat at their mouths into the slot 80, which is achieved in a simple manner by forming the edges of the bores with a chisel. Therefore it is impossible for the balls to fall into the slot, but they are pressed partially into the slot 80 by the compression springs 15*m*. The dimensions are made so that the balls retain the support rail 19*m* under pressure when it is pressed in.

Figure 15:
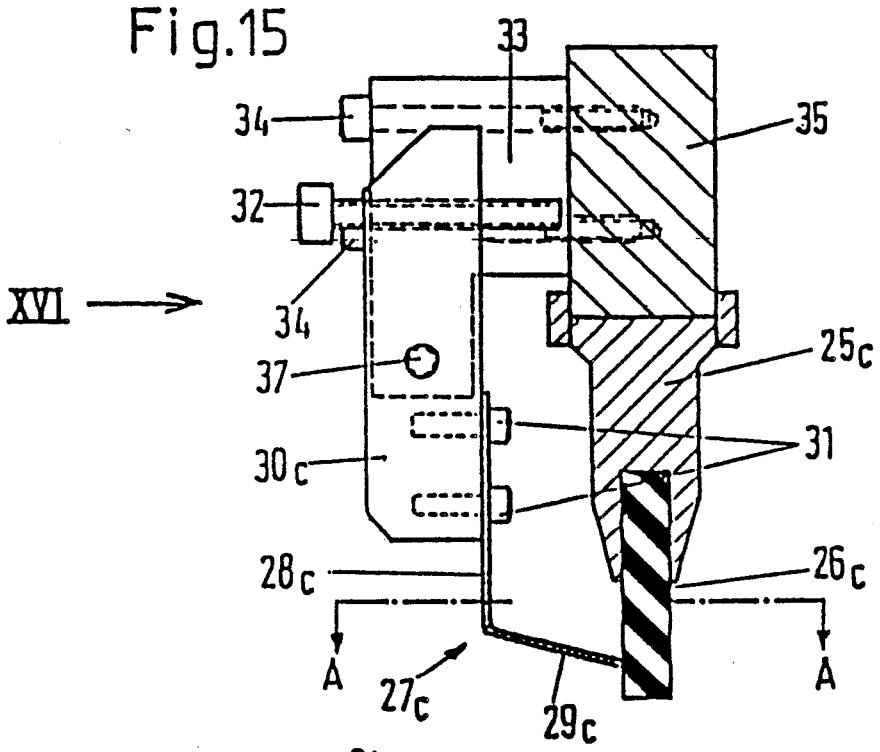
FIG. 15 shows a section through parts of a variant pressure head according to the invention with bracing profile, in which the bracing profile is pressed pivotably and resiliently into contact.
Figure 16:
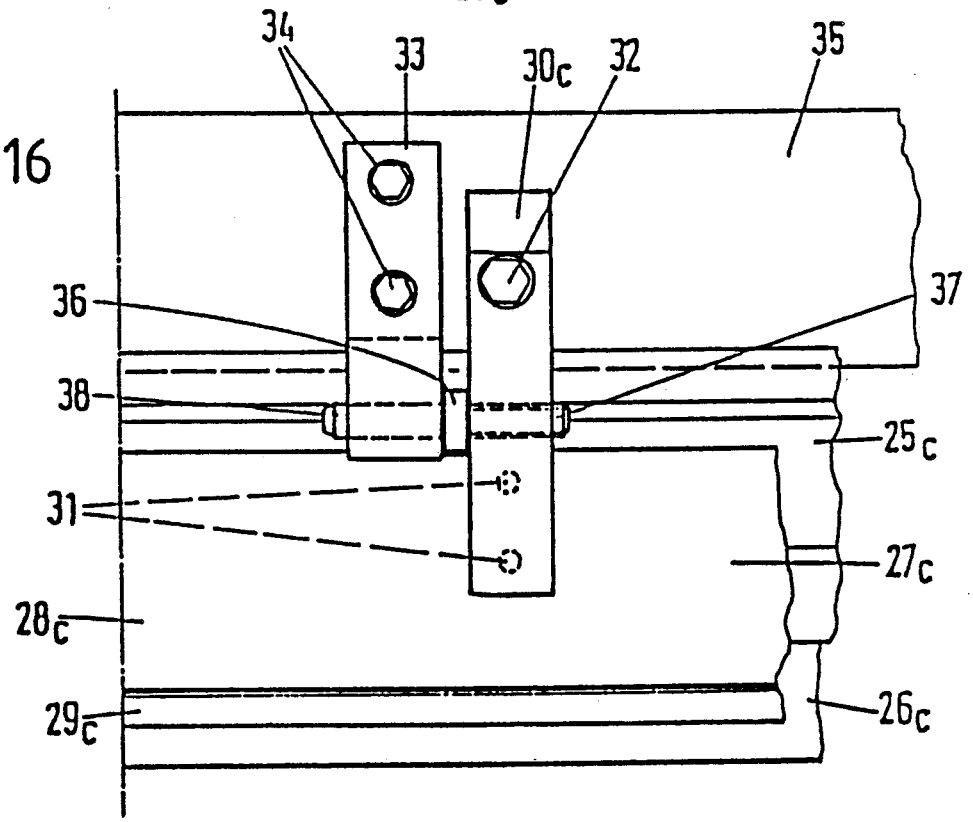
FIG. 16 shows a partial view of the pressure head, viewed in the direction of the arrow XVI in FIG. 15.

In the embodiment according to FIGS. 15 and 16 the doctor bracket 35 carries a solid support rail 25*c*, into which a profile bar 26*c* made of soft rubber is inserted on its underside. The support rail 25*c* is plugged onto the doctor bracket 35 and is retained on the latter by fastening means not shown.

The doctor bracket 35 further carries a plurality of supports 33, which are distributed along its length and are fastened, each by two fastening screws 34, to the doctor bracket 35. Each of these supports 33 has at its lower free end a transverse bore (no reference numeral), which is oriented parallel to the longitudinal direction of the doctor bracket 35. This bore accommodates the bearing part 38 of a bearing bolt 36, which has a screwthreaded part 37 at its other end. The bearing bolt 36 is engaged firmly by this screwthreaded part 37 in a screwthreaded bore in a bracket 30*c*. Each of these brackets 30*c* distributed along the length of the doctor bracket is screwed by two screws 31 to an angled bracing profile 27*c*, namely to the upper member 28*c* of the latter, whereas the lower member 29*c* contacts and braces the profile bar 26*c*. The bracing profile 27*c* is therefore carried at a plurality of points on its length by such brackets 30*c*, which are each connected pivotably to the doctor bracket 35 via the bearing bolts 36 and the supports 33.

However, the free pivotability of the bracing profile 27*c* relative to the doctor bracket 35 is limited towards one side at each individual bracket 30*c* by an adjusting screw (32) engaged into the latter, whereas a free pivotability towards the other side is limited by the fact that the member 29*c* of the bracing profile 27*c* contacts the pressure profile 26*c*.

By engaging the adjusting screws 32 more deeply, it is therefore possible to obtain a pivoting of the individual brackets 30*c* and therefore of the bracing profile 27*c*, counterclockwise (in FIG. 3) and thereby to modify by the bracing force the bending of this doctor profile which occurs during operation, that is to say after the profile bar 26*c* has been applied to the screen fabric. Particularly, however, if the profile bar 26*c* should not be aligned quite uniformly along its length, or if for any other reasons the ink application should vary transversely across the profile bar 26*c*, then these differences can be eliminated by adjusting the individual adjusting screws 32 of the brackets 30*c* in various manners.

Because the bracing profile 27*c* consists of relatively thin sheet steel, a slight bending of the bracing profile 27*c* along its length can be effected at will by means of the adjusting screws 32, if only slight flexures are involved.

Figure 17:
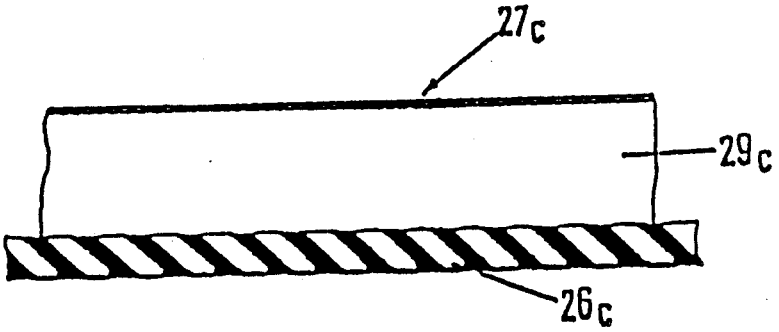
FIG. 17 shows a section made along the line A—A in FIG. 15.

FIG. 17 illustrates the bracing profile 27*c* with its lower member 29*c*, which rests upon and supports the profile bar 26*c*.

Figure 18:
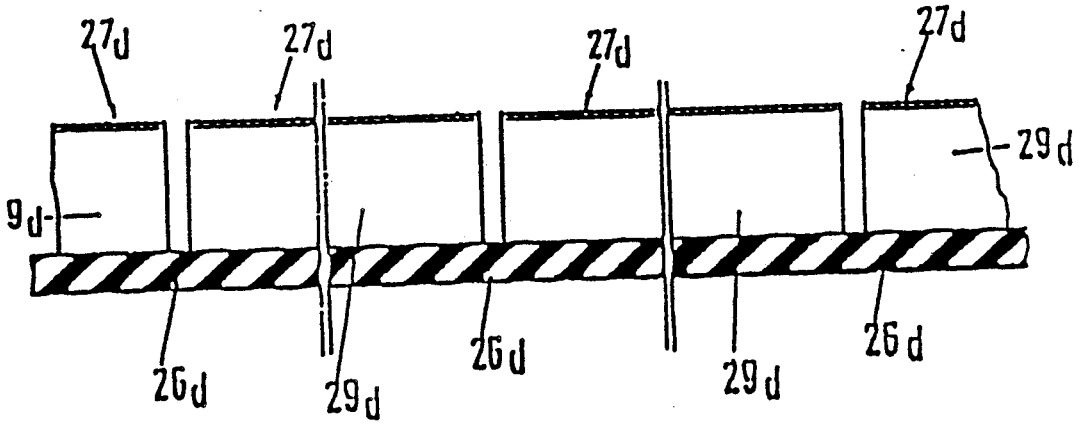
FIG. 18 shows a section similar to FIG. 17, but with a composite bracing profile.

However, no greater deformation of the bracing profile is possible due to its angled shape. If it is desired to effect greater flexures, it is convenient to make use of the composite construction of the bracing profile illustrated in FIG. 18, where it consists of a plurality of short parts 27*d*. The lower members 29*d* of these individual parts contact the profile bar 26*d* in juxtaposition. The upper members of the individual bracing profiles 27*d* are then each fastened to individual brackets, which can be adjusted mutually independently by their adjusting screws (not shown).

It has been discovered that by means of such a construction of the bracing means, given desired variations in the ink application along the length of the profile bar, which are desired for certain printing tasks, can actually be effected.

The useful life of such a pressure doctor is considerably prolonged compared to the known pressure doctors, and virtually no uncontrolled modifications occur even after a large number of printing operations. As a result, and as experiments have shown, the printing capacities of a screen process printing press can be increased by approximately 30% and more.

Figure 19:
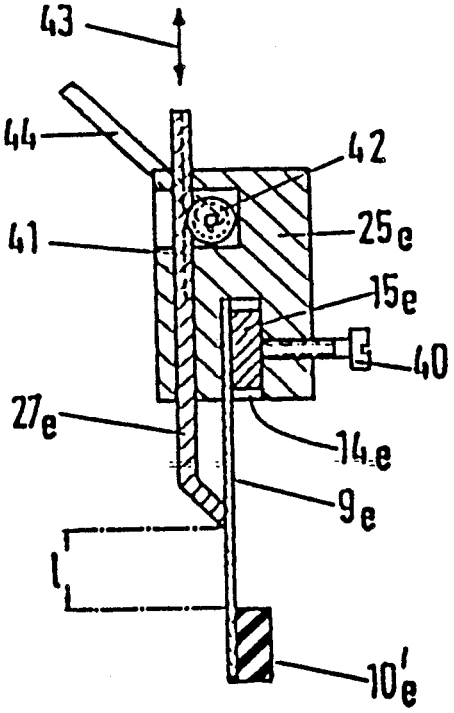
FIG. 19 shows a section through a doctor bracket with slidable bracing profile.

The doctor bracket 25*e* illustrated in FIG. 19 again has, at its underside, a slot 14*e* into which a support rail 9*e* made of sheet steel with a profile bar 10*e* made of soft rubber is inserted, while again a steel bar 15*e* is placed underneath and the fastening is effected by screws 40.

The doctor bracket 25*e* has, at an interval from the abovementioned slot 14*e*, a further slot which penetrates it continuously from top to bottom. However, webs (not shown) are provided at certain intervals distributed along the length of the doctor bracket 25*e*, which pass through the abovementioned slot and retain that part of the doctor bracket 25*e* located to the left of the slot. The upper member 27*e* of the angled bracing profile, the lower member of which contact the support rail 9*e*, is arranged slidably in the said slot. The upper member of the bracing profile 27*e*, which is slidable in the slot, is provided with a tooth system 41, with which a pinion 42 mounted rotatably in the doctor bracket 25*e* meshes. This pinion can be rotated by a lever 44, so that the bracing profile 27*e* then also moves positively downwards or upwards in the direction of the arrow 43. By this means the free length "l" of the support rail 9*e* can be modified within certain limits, whereby the spring characteristic can then be modified at will.

It is evident that the adjustment of the bracing profile in order to modify the spring characteristic of the support rail 9*e* must be performed uniformly along the total length. Toothed pinions 42 will therefore be provided at least at both ends of the doctor bracket 25*e*, and their uniform movement will be insured. This can be effected by a continuous common shaft for the two toothed pinions, for example.

Figure 20:
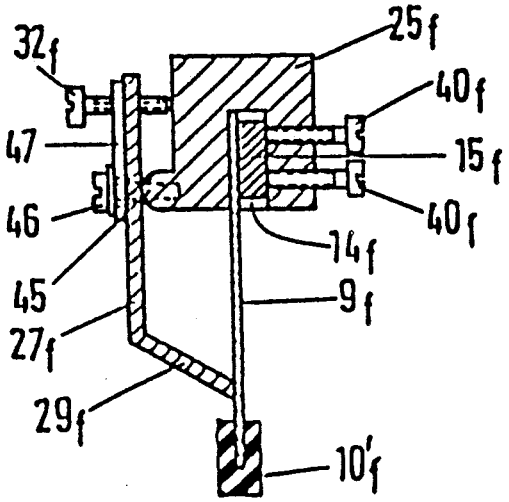
FIG. 20 shows a section through a doctor bracket with pivotable bracing profile.

In the embodiment according to FIG. 20 the doctor bracket 25*f* again has at its underside a slot 14*f* to accommodate a support rail 9*f* made of sheet steel, with a profile bar 10*f* made of soft rubber attached underneath. A steel bar 15*f*, which can be tightened by screws 40*f*, is again placed in the slot.

The doctor bracket 25*f* has at its left lower end in FIG. 20 a rounded projection 45, which serves as a pivot bearing for a bracing profile 27*f*. This bracing profile is angled at its underside and presses with the lower member 29*f* against the support rail 9*f*.

A screw 46, which is engaged in the said projection 45, extends through a somewhat wider bore in the upper member of the bracing profile 27*f*. This bracing profile is pivotable to a limited degree by this means.

A bracing plate 47, which reinforces the end of the bracing profile 27*f*, rests upon the upper part of the bracing profile, and is likewise retained by the screw 46. An adjusting screw 32*f*, which contacts with its end the adjacent surface of the doctor profile 25*f*, is engaged through the upper end of the bracing profile and of the bracing plate. By screwing in this adjusting screw, the bracing profile 27*f* is pivoted counterclockwise and therefore bends the support rail 9*f* likewise counterclockwise.

Figure 21:
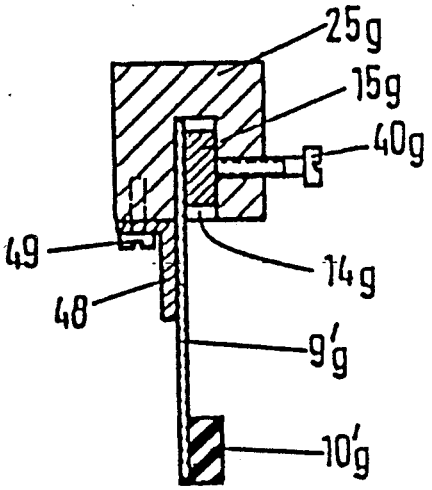
FIG. 21 shows a section through a doctor bracket with fixed bracing angle.

FIG. 21 shows a doctor bracket 25*g* with an accommodating slot 14*g* and fastening screw or, fastening screws 40*g*. Here again, a support rail 9'*g* made of hard plastic material with a profile bar 10'*g* made of soft resilient plastic material stuck on at the bottom is inserted with interposition of a steel bar 15*g*.

Figure 22:
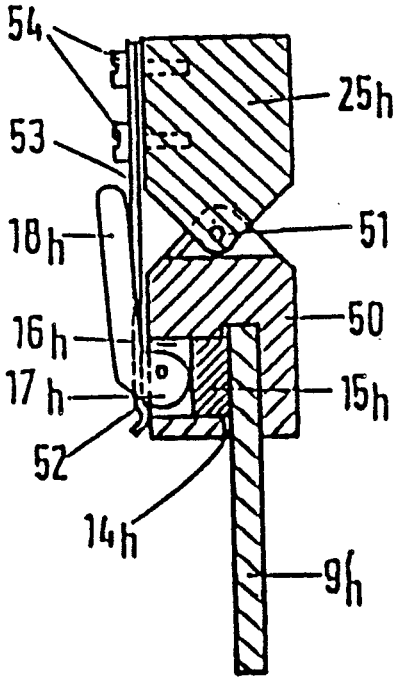
FIG. 22 shows a section through a doctor bracket with clamping lever and articulation.

A continuous bracing angle 48, which is screwed to the underside of the doctor bracket 25*g* by means of screws 49, contacts snugly and thus braces one side of the support rail 9'*g* with its free downward projecting member. The doctor bracket illustrated in FIG. 22 consists of an upper part 25*h* which is to be clamped in the pressure head, and a lower part 50, to be connected to the latter by an articulation 51 and again has at its underside a slot 14*h* to accommodate a support rail 9*h* made of a rigid plastic material. Here again, a steel bar 15*h* is inserted into the aperture 16*h*, and the fastening is effected by a clamping lever 18*h*, which is constructed as an eccentric 17*h* in its part adjacent to the articulation. A leaf spring 53, which is fastened by screws 54 in the upper part 25*h* of the doctor bracket, presses with its lower free end against the upper part 50 of the doctor bracket, and pivots the lower part 50, and therefore the support rail 9*h*, to the right when the upper part 25*h* is clamped.

Figure 23:
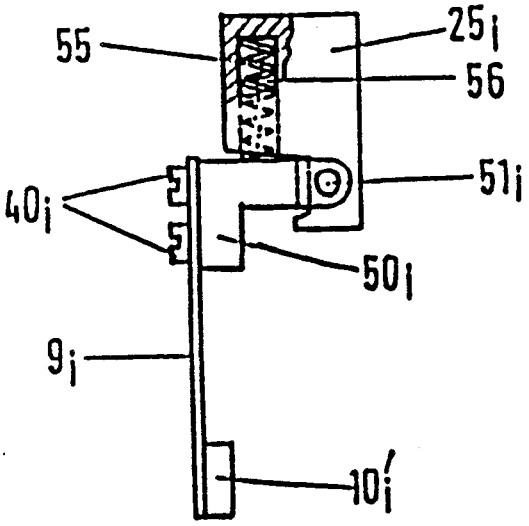
FIG. 23 shows a section through a doctor bracket with articulation.

FIG. 23 shows another embodiment of a two-piece doctor bracket, the two halves 25*i* and 50*i* of which are mutually pivotably connected by an articulation 51*i*. The upper part 25*i* is intended for clamping in the pressure head of a screen process printing press, and has a blind bore 55 into which a helicoidal compression spring 56 is inserted. In the case of a very long doctor bracket, two or more such bores with helicoidal compression springs are conveniently provided.

The lower part 50*i* of the doctor bracket is constructed with an angular profile and carries, by means of screws 40*i*, a support rail 9*i* made of a hard plastic material, which carries at its underside a profile bar 10'*i* made of soft resilient plastic material.

The helicoidal compression spring 56 presses with its lower end against the upper side of the lower part 50*i* of the doctor bracket, and thereby pivots the latter, and with it the support rail 9*i*, counterclockwise.

Figure 24:
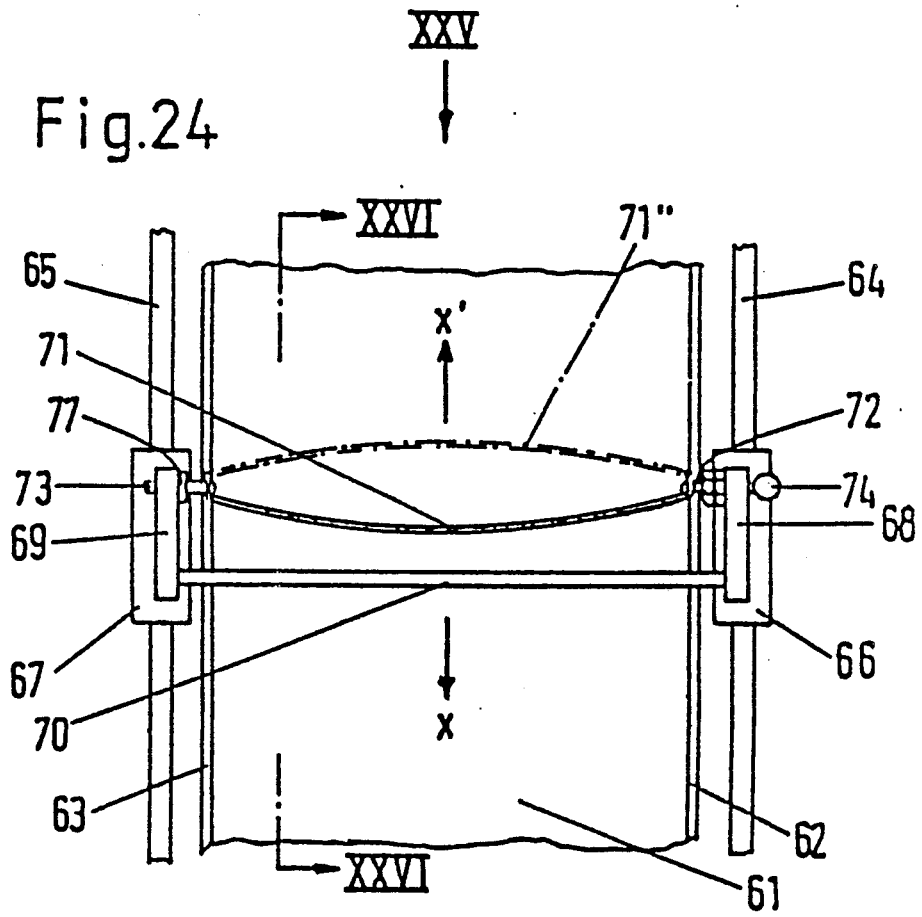
FIG. 24 shows a plan of a pressure head with doctor bracket and preliminary doctor, and of part of the screen process printing press located beneath the pressure head.
Figure 25:
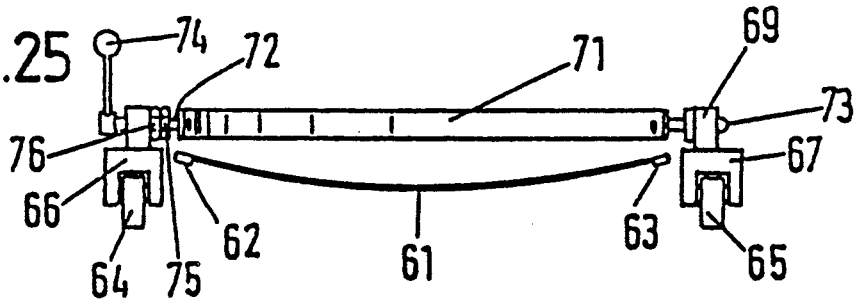
FIG. 25 shows a view in the direction of the arrow XXV in FIG. 24.
Figure 26:
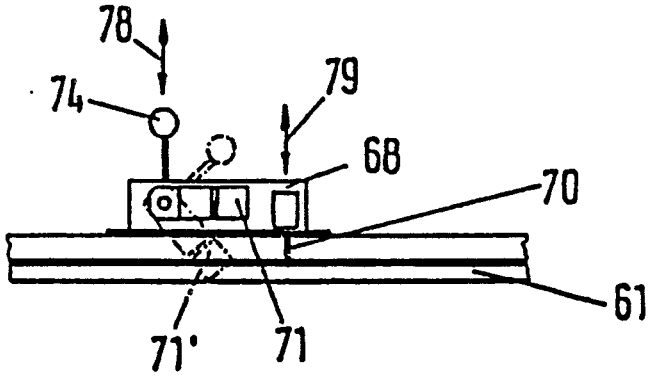
FIG. 26 shows a section made along the line XXVI in FIG. 24.

As already explained initially, the pressure head illustrated in FIGS. 24 to 26 comprises, not only the actual pressure doctor, but a preliminary doctor 71 or 71'' staggered relative to the pressure doctor in the longitudinal direction of the screens. Both the pressure doctor 70 and the preliminary doctor 71 are carried at their ends by mounting elements 68, 69, which are arranged on the carriages 66, 67. The mounting elements 68, 69 comprise mechanisms by which the pressure doctor 70 can be lowered in order to press upon the screen 61 and then raised again. The mounting elements 68, 69 for the preliminary doctor 71 comprise of identical mechanisms. The two mechanisms co-operate so that when the pressure doctor is lowered, the preliminary doctor is raised. When the preliminary doctor 71 is lowered, the mechanisms automatically raise the pressure doctor 70.

In the exemplary embodiment illustrated in the drawing, the preliminary doctor 71 is formed by a band-shaped element which is arcuately curved. The curvature is shown by solid lines in FIG. 24. (However, the band-shaped element may also be arcuately curved in the opposite direction, as is illustrated by chain-dotted lines at 71" in FIG. 24.)

The two ends of the band-shaped element carry journals 72, 73. These journals are mounted rotatably in the mounting elements 68, 69. The journal 73 carries a fixed stop disc 77, so that it cannot move into the mounting element farther than illustrated in the drawing.

On the other hand, the journal 72 is provided, in the region lying between the end of the band-shaped doctor preceding the latter. The pressure head is constructed so that either the preliminary doctor or the pressure doctor is lowered alternately onto the screen, the other doctor being raised meanwhile. This technique is known, and the preliminary doctor serves to distribute the ink applied to the screen as uniformly as possible across the screen before the impression. To enable the advance to be explained better, not only the further development of the pressure head according to the invention, but also the screen located beneath the latter, is illustrated in FIGS. 24 to 26.

This screen 61 of a screen process printing press, which is indicated only by two rails 64, 65 extending beside the screen in its longitudinal direction, may consist of silk, nylon or V2A steel wire or, for textile printing, of polyester or bronze wire with a varying mesh number. The screen exhibits at its longitudinal edges reinforcing means 62, which are likewise clamped when the screen is clamped in a longitudinal direction. However, the central region of the screen in the transverse direction sags more or less, as a function of the different material characteristics.

Rails 64, 65, upon which the pressure head is arranged slidably, extend beside the screen 61 in its longitudinal direction. The pressure head comprises two carriages 66, 67 guided on the rails, a pressure doctor 70 extending between the carriages and lowerable in order to press upon the screen 61, and a preliminary element and the mounting element, with a male screwthread, upon which nuts 75, 76 are engaged. When the nuts on the screwthreaded region of the journal 72 are screwed away from the end of the band-shaped element, the journal 72 is slid out of the mounting element 69 towards the other journal 73. By sliding the journal, a predetermined curvature of the band-shaped element can be adjusted. The curvature adjusted is secured by tightening both the nuts 75, 76. The free end of the journal 72 is provided integrally in rotation with a handle 74. By the latter, the entire preliminary doctor can be pivoted about the axis of the two journals 72, 73. The curved region of the preliminary doctor can thus be lowered onto the screen as illustrated by chain-dotted lines at 71' in FIG. 26. This causes the work edge of the preliminary doctor to be adapted to the sagging surface of the screen.

When printing ink is applied to the centre of the screen, and the preliminary doctor, after being pivoted, is lowered into the desired position as indicated by the arrow 78 in FIG. 26, the printing ink applied will, during the advancing movement of the pressure head in the direction of arrow X, arrive in front of the obliquely positioned surface of the preliminary doctor 71'. During the further movement of the pressure head in the direction of the arrow X, the printing ink, which is at first present only in the centre, moves along the work edge of the preliminary doctor outwards, that is to say towards the two edges of the band. In this manner the printing ink becomes distributed across the total width of the band 61 during the advancing movement of the pressure head. After this operation the preliminary doctor 71' is raised in the direction of the arrow 78 by the corresponding mechanism, while the pressure doctor 70 is lowered in the direction of the arrow 79. The support to be printed is then moved upwards against the screen, while the pressure head is moved in the direction of the arrow X', while the lowered pressure doctor 70 presses the ink through the screen onto the support.

When the printing process is completed, the pressure doctor 70 is raised again in the direction of the arrow 79, whereby the preliminary doctor 71' is lowered onto the screen 61, which is now sagging in its central region. During the return of the pressure head in the direction of the arrow X, printing ink is again distributed uniformly across the total width of the screen 61, so that a fresh printing process can commence after the reversal of the mechanisms, that is to say lowering the pressure doctor 70 and raising the preliminary doctor 71'.

If the preliminary doctor is curved in the manner indicated by chain-dotted lines designated 71" in FIG. 24, then the movements are effected correspondingly reversed.

I claim:

1. A pressure head for a screen printing press which is guided with reciprocating sliding mobility in the longitudinal direction of the screen, the pressure head comprising:

a pressure doctor oriented transversely to the longitudinal direction of the screen and which can be lowered onto the screen, wherein the pressure doctor comprises a doctor bracket with an elongate support rail made of a hard resilient material removably inserted into said doctor bracket;

and a profile bar made of a soft resilient material located on the edge of said support rail underneath said hard resilient material on the edge thereof, and connected to said support rail;

the support rail is in the form of a plate which is thin in comparison to its width.

2. A pressure head according to claim 1 wherein said profile bar has a rectangular cross-section.

3. A pressure head according to claim 1 wherein said profile bar has a U-shaped cross-section.

4. A pressure head according to claim 1 wherein the support rail is made of sheet steel.

5. A pressure head according to claim 1 wherein the profile bar is made of natural or synthetic rubber.

* * * * *